US005860037A

United States Patent [19]

Kurokawa

[11] Patent Number: 5,860,037

[45] Date of Patent: Jan. 12, 1999

[54] PHOTOSENSITIVE MATERIAL PROCESSING DEVICE

[75] Inventor: Toshio Kurokawa, Minami-ashigara, Japan

[73] Assignee: Fuji Photo Film Co., Ltd., Kanagawa, Japan

[21] Appl. No.: 792,198

[22] Filed: Jan. 30, 1997

[30] Foreign Application Priority Data

Jan. 31, 1996 [JP] Japan ..... 8-015179

[51] Int. Cl.[6] ..... G03D 3/08; G03D 13/02

[52] U.S. Cl. ..... 396/617; 396/620; 396/636

[58] Field of Search ..... 396/647, 636, 396/617, 620, 622, 604, 641, 612, 624

[56] References Cited

U.S. PATENT DOCUMENTS 4,980,714 12/1990 Nakamura et al. .
5,319,410 6/1994 Glover et al. ..... 396/626

FOREIGN PATENT DOCUMENTS 0 456 210 11/1991 European Pat. Off. ..... G03C 5/26
2-103043 4/1990 Japan ..... G03D 3/08
2-204741 8/1990 Japan ..... G03D 3/00
2-232656 9/1990 Japan ..... G03D 3/00

*Primary Examiner*—D. Rutledge
*Attorney, Agent, or Firm*—Sughrue, Mion, Zinn, Macpeak & Seas, PLLC

[57] ABSTRACT

A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25. As a result, slidability of the silver halide photosensitive material in the processing tank is increased so that conveyability of the silver halide photosensitive material within the processing tank can be improved.

19 Claims, 13 Drawing Sheets

PHOTOSENSITIVE MATERIAL PROCESSING DEVICE

BACKGROUND OF THE INVENTION

1. Field of the Invention

The present invention relates to a photosensitive material processing device which holds a small amount of processing solution and is well-suited for the developing process of negative films used for photography.

2. Description of the Related Art

A negative film used for photography, which is a silver halide photosensitive material, must be subjected to a developing process after being photographed. To this end, the photographed negative film is sent into a processing device for developing negative films in which processing solutions such as color developing solution, bleach fixing solution, washing water and the like are stored in respective processing tanks. The negative film is successively immersed in color developing solution, bleach fixing solution, and washing water so as to be subjected to the developing process. In order to carry out a reliable developing process, a large amount of processing solution must be stored in each of the conventional processing tanks housed within the processing device.

Further, because deterioration of the processing solution is promoted by oxidization, even when only a small amount of the processing solution is needed for processing negative films per day, in order to maintain high quality development of negative films, a large amount of replenishing solution must be replenished into the processing solution in conformity with the large amount of the processing solution so that the characteristics of the processing solution can always be maintained constant.

As described above, because it is necessary for the above processing device to use a large amount of the processing solution, in order to stabilize the processing solution, it is also necessary to use a large amount of the replenishing solution, accordingly. Therefore, the cost of operating the processing device increases and processing tanks are made large to store a large amount of processing solutions so that the processing device for housing the processing tanks which have been made large, needs to be large.

In order to solve the aforementioned drawbacks, a method of improving a processing device by making processing tanks compact and by storing a small amount of processing solutions in the processing tanks can be found. However, drawbacks arise in that when the processing tanks are made compact, a negative film easily contacts the inner wall surfaces of the processing tanks so that conveyability of the negative film deteriorates.

In recent years, there exists a photosensitive material processing device in which a magnetic writing layer is disposed on a negative film and information for processing the negative film or the like can be written into the negative film. However, there has been a drawback in that because the magnetic writing layer on the negative film contacts the inner wall surfaces of the processing tanks, the magnetic writing layer is damaged by abrasion or the like so that reading accuracy of the magnetic information decreases.

SUMMARY OF THE INVENTION

In view of the aforementioned facts, it is an object of the present invention to provide a photosensitive material processing device in which conveyability of the photosensitive material and reading accuracy of the magnetic information on the photosensitive material can be improved.

In accordance with one aspect of the present invention, there is provided a photosensitive material processing device having a processing tank in which is stored the processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25.

Hereinafter, the following effects are achieved by this photosensitive material processing device.

The tank volume of the processing tank for processing the silver halide photosensitive material is V ml. The path length which is a conveying distance from a position at which a silver halide photosensitive material begins to contact the processing solution within the processing tank to a position at which the silver halide photosensitive material is discharged from the processing solution is L cm. The processing tank is structured such that the value of V/L is 25 or less. The processing tank is formed from a crystalline resin.

Therefore, even when the processing tank is long and thin and has a value V/L of 25 or less, because the processing tank is formed from a crystalline resin, slidability of the silver halide photosensitive material within the processing tank is increased and conveyability of the silver halide photosensitive material within the processing tank can be improved.

As described above, since the amounts of the processing solutions can be reduced, there is no need for a large amount of replenishing solution in order to maintain the characteristics of the processing solutions. Further, because the amounts of the processing solutions are reduced, the sizes of the processing tanks for storing the processing solutions can be minimized so that a photosensitive material processing device can be made compact, accordingly.

In accordance with another aspect of the present invention, a photosensitive material processing device having a processing tank in which is stored processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is 25 or less, and a substrate of the silver halide photosensitive material is made from polyethylenenaphtalate and a magnetic writing layer is formed thereon.

The following effects are achieved by this photosensitive material processing device. Further, the photosensitive material processing device is structured such that the substrate of the silver halide photosensitive material is made from polyethylenenaphthalete and the magnetic writing layer is formed thereon.

To this end, conveyability of the silver halide photosensitive material improves. Moreover, because the substrate of the silver halide photosensitive material is made from polyethylenenaphtalate, the surfaces of the silver halide photosensitive material are not easily subjected to abrasion. Accordingly, reading accuracy of magnetic information on the magnetic writing layer can be improved.

In accordance with yet another aspect of the present invention, a photosensitive material processing device having a processing tank in which is stored processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and the thickness of the substrate of the silver halide photosensitive material is less than or equal to 100 μm.

The following effects are achieved by this photosensitive material processing device.

In accordance with the present aspect, the same effects as those of the above described first aspect are achieved. Further, the thickness of the substrate of the silver halide photosensitive material is 100 μm or less. Therefore, when the substrate of the silver halide photosensitive material is thinned to be 100 μm or less in thickness, flexibility of the silver halide photosensitive material also increases so as to correspond to the above thickness by which the substrate is thinned. Even when the silver halide photosensitive material must be passed through a processing tank which is long and thin and has a value V/L of 25 or less, the silver halide photosensitive material is bent enough to be conveyed in the processing tank without any problem.

DETAILED DESCRIPTION OF THE PREFERRED EMBODIMENT

A description of a photosensitive material processing device according to an embodiment of the present invention will be given with reference to the drawings.

Figure 1:
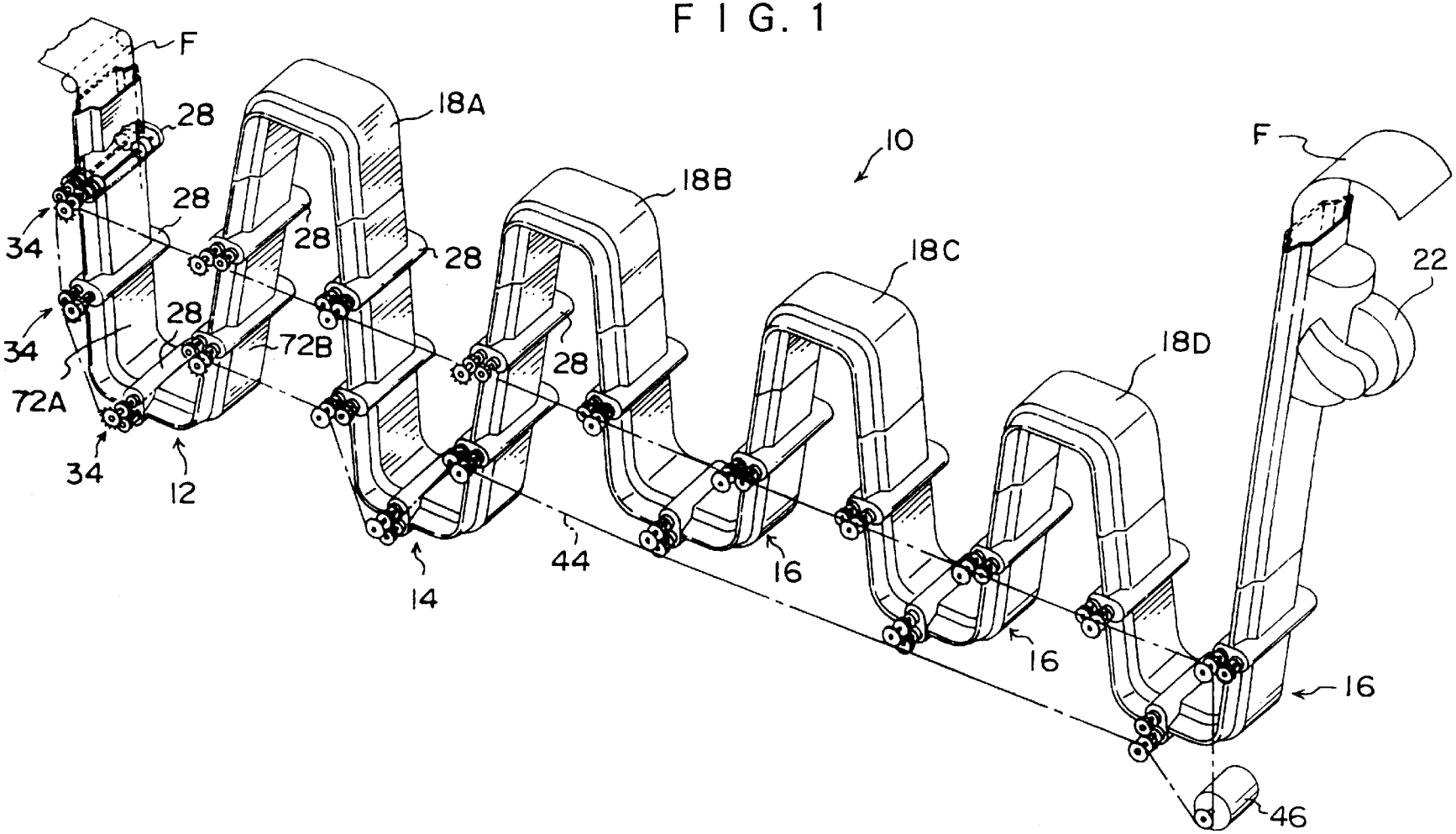
FIG. 1 is an overall schematic structural view of a photosensitive material processing device according to an embodiment of the present invention.

As shown in FIG. 1, in a photosensitive material processing device 10 according to the present embodiment, a bleaching/fixing tank 14, which is formed from a crystalline resin and in a U-shape, is connected via a connecting member 18A to a color developing tank 12, which is also formed from a crystalline resin and in a U-shape. Three stabilizing tanks 16, which are formed from crystalline resins and in U-shapes and are connected in a row via connecting members 18C, 18D, are connected to the bleaching/fixing tank 14 via a connecting member 18B. Color developing solution is stored in the color developing tank 12, bleaching/fixing solution is stored in the bleaching/fixing tank 14 and washing water is stored in each of the three stabilizing tanks 16.

Accordingly, when a color negative film F which has been photographed is inserted from the open end side of the color developing tank 12 of the photosensitive material processing device 10, the color negative film F is immersed successively in the processing tanks such as the color developing tank 12, the bleaching/fixing tank 14 and the three stabilizing tank 16, so as to be subjected to developing processing.

A drying fan 22 is disposed at the open end of the last stabilizing tank 16. The color negative film F which has exited from the stabilizing tanks 16 is inserted into and dried at the drying fan 22. A cover which is not shown is mounted or the photosensitive material processing device 10 so as to cover the processing tanks on the whole.

Figure 7:
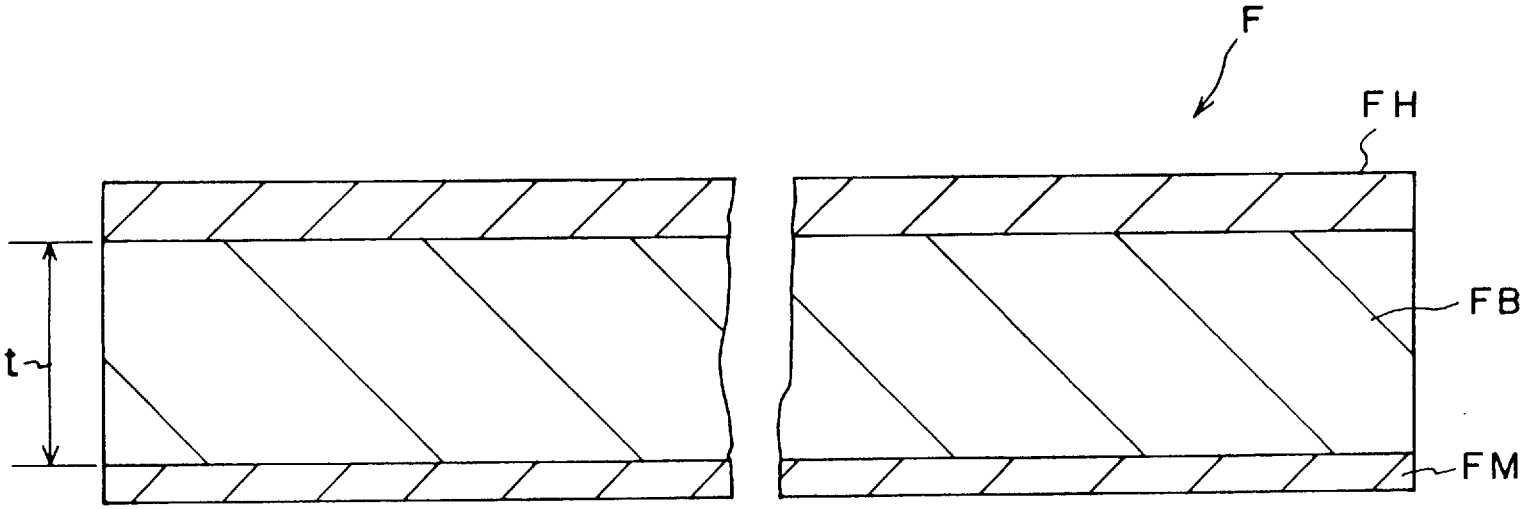
FIG. 7 is a schematic cross-sectional view of a color negative film which is applied to the present embodiment.

On the other hand, as shown in FIG. 7, in a color negative film F to be subjected to developing processing, the color negative film F has a thickness t of 100 μm or less and 70 μm or more, and preferably a thickness t of 95 μm or less and 80 μm or more. Further, the color negative film F is consisted of a silver halide photosensitive layer FH and a magnetic writing layer FM which are coated and disposed on a substrate FB made from polyethylenenaphtalate. The width of the color negative film F is less than or equal to 30 mm.

Figure 2:
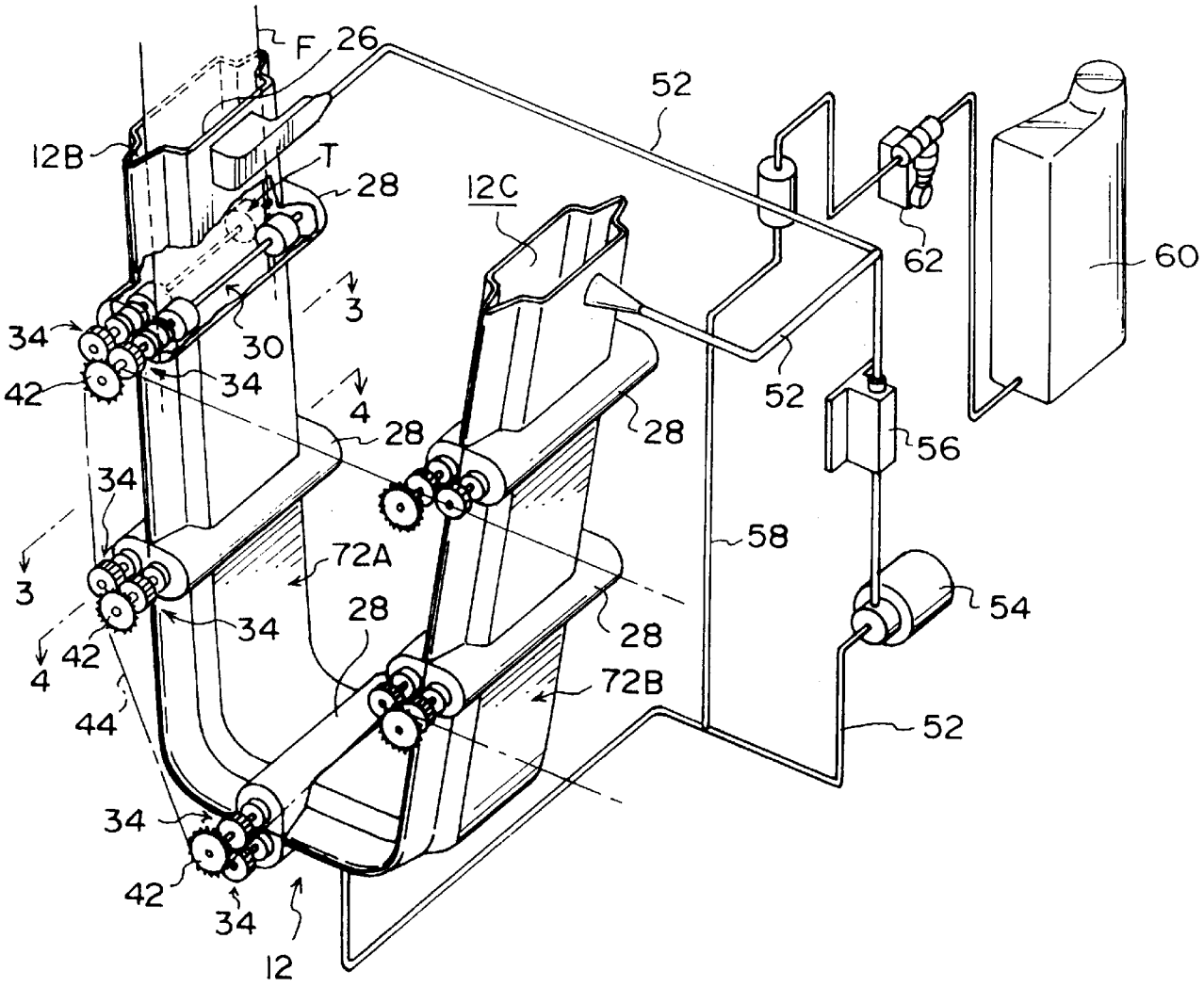
FIG. 2 is an enlarged schematic view of a periphery of a color developing tank according to the present embodiment.
Figure 3:
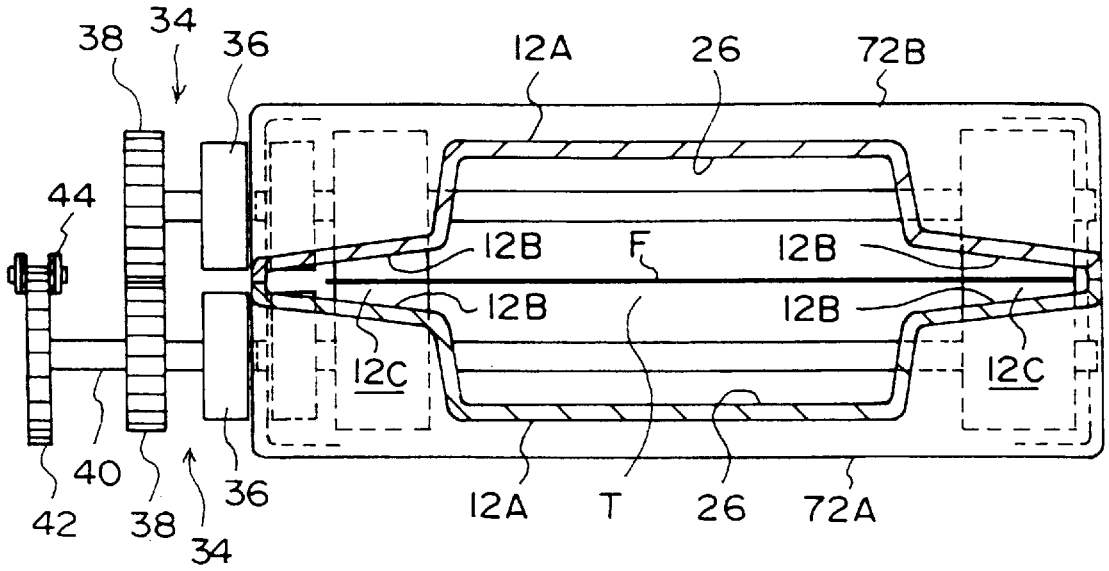
FIG. 3 is a view taken along line 3—3 of a color developing tank in FIG. 2.

The color developing tank 12 is shown in the enlarged view of FIG. 2 and the transverse cross-section of the color developing tank 12 is shown in FIG. 3. As shown in FIG. 3, a space 12C in the color developing tank 12 is formed in a slit shape in guide portions 12B, which are portions of the inner wall surface of the color developing tank 12, so that the color negative film F is guided and conveyed by the guide portions 12B.

More specifically, the space 12C is formed by the guide portions 12B in a slit-shape such that the transverse direction length of the space 12C in the color developing tank 12 is slightly larger than the transverse dimension of the color negative film F and such that the thickness of the space 12C is slightly larger than the thickness of the color negative film F. As a result, the guide portions 12B form a U-shaped conveying path T for the color negative film F. Concave portions 26 are formed in groove shapes along the conveying path T in wall portions 12A of the transverse direction central portion of the color developing tank 12. The concave portions 26 are recesses in the top and bottom surfaces of the wall portions 12A as seen in FIG. 3. The concave portions 26 are formed so that the inner wall surfaces of the color developing tank 12 do not contact the image forming members of the negative film F.

Figure 6:
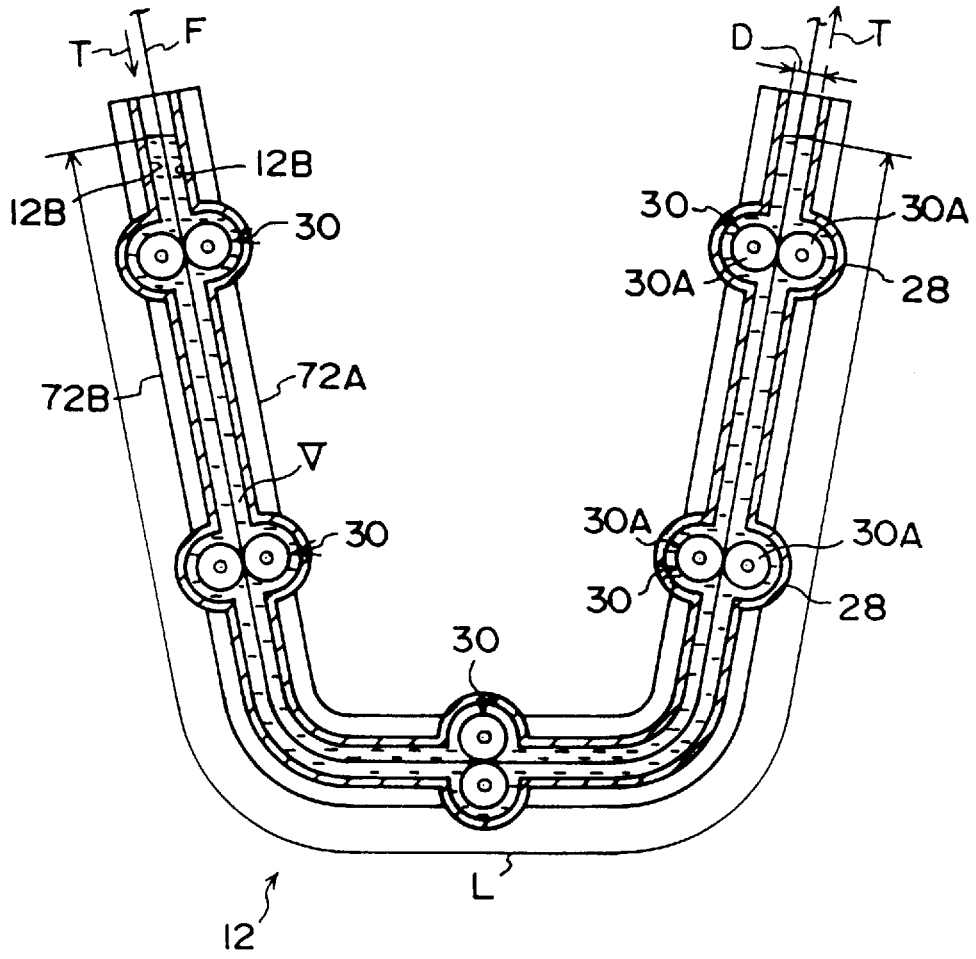
FIG. 6 is a cross-sectional view of the color developing tank according to the present embodiment.

The color developing tank 12 is a slit-shaped tank. As illustrated in FIG. 6, the tank volume of the color developing tank 12 is V milliliters. The path distance, which is the conveying distance from the position at which the color negative film F begins to contact the color developing solution to the position at which the color negative film F is discharged from the color developing solution, is L cm. The color developing tank 12 has a value of V/L of 25 or less, and is made to hold a small amount of color developing solution.

The tank volume does not include the volume of the amount of solution in the circulation system or the volume of the subtank used for regulating the temperature of the color developing solution, or the like.

Slit-shaped spaces are similarly formed in the inner portions of the other processing tanks such as the bleaching/fixing tank 14 and the stabilizing tanks 16. In the same way as the color developing tank 12, the connecting members 18A, 18B, 18C, 18D are each formed in a U-shape having a slit-shaped path in the interior thereof. The connecting members 18A, 18B, 18C, 18D are disposed in inverse U-shapes in order to connect the color developing tank 12, the bleaching/fixing tank 14, and the three stabilizing tanks 16.

Figure 4:
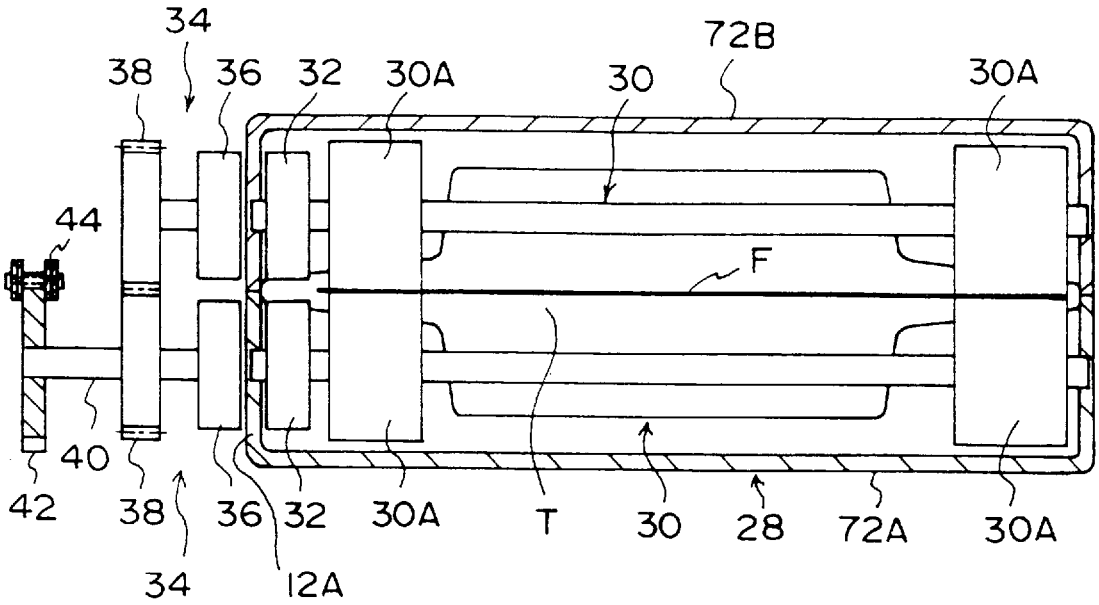
FIG. 4 is a view taken along line 4—4 of the color developing tank in FIG. 2.

As illustrated in FIGS. 2 and 4, at the processing tank 12, bulging portions 28 which are swelled spaces, are disposed at predetermined intervals at five places along the U-shaped conveying path T of the negative film F. A pair of conveying rollers 30, which are conveying means having drive wheels 30A at the ends thereof, are disposed in the bulging portions 28 so as to be rotatable and so as to oppose one another.

Accordingly, when the pairs of conveying rollers 30 are rotated, the negative film F is conveyed along the conveying path T within the developing tank 12 while perforation portions of the color negative film F are nipped between the drive wheels 30A of the pairs of conveying rollers 30.

A disc-shaped magnet 32, whose magnetic poles are disposed so as to be aligned along the peripheral direction, is mounted to one drive wheel 30A of each conveying roller 30. Transmission rollers 34 are disposed at the outer side portion of the color developing tank 12 so as to oppose the magnets 32 of the conveying rollers 30 with the wall portion 12A of the color developing tank 12 disposed therebetween. In the same way as the drive wheel 30A of the conveying roller 30, a disc-shaped magnet 36, whose magnetic poles are disposed so as to be aligned along the peripheral direction, is provided at one end side of the transmission roller 34, which is the end side which faces the magnet 32. A gear 38 is mounted to the other end side of the transmission roller 34. The gears 38 of the pair of transmission rollers 34 mesh with one another.

A sprocket 42 is mounted to the distal end portion of a rotating shaft 40 which projects further than the other end side of one of the transmission rollers 34 of the pair of transmission rollers 34. A plurality of the bulging portions 28 which house pairs of the conveying rollers 30 are formed as well, at the other processing tanks such as the bleaching/fixing tank 14 and the stabilizing tanks 16. Pairs of the transmission rollers 34 having the sprockets 42 are disposed at these bulging portions 28 as well. A chain 44 is entrained around the respective sprockets 42 of the entire photosensitive material processing device 10. The chain 44 is driven to rotate by a motor 46 disposed within the photosensitive material processing device 10.

As the chain 44 is rotated by the motor 46, the ones of the transmission rollers 34 having the sprockets 42 are respectively rotated, and accordingly, the others of the transmission rollers 34 are also rotated due to the meshing together of the gears 38. As a result, the magnets 32 of the conveying rollers 30, which oppose the magnets 36 of the pair of transmission rollers 34 via the wall portions 12A of the color developing tank 12, are effected by magnetism, and the pairs of conveying rollers 30 having the magnets 32 are rotated together with the pairs of transmission rollers 34.

As illustrated in FIG. 2, piping 52 which is a circulating path, is disposed so as to connect the central portion of the developing tank 12, which is the lowest portion, and portions of the color developing tank 12 near the introduction and discharge sides. A pump 54, for sending the color developing solution from the central portion of the color developing tank 12 to the portions of the color developing tank 12 near the introduction side and the discharge side, is disposed on the path of the piping 52. A heater 56, which heats the color processing solution sent from the pump 54 to a predetermined temperature, is disposed at a position of the piping 52 downstream of the pump 54.

An unillustrated sensor is assembled in the heater 56 and detects the temperature of the color developing solution flowing in the piping 52. The operating state of the heater 56 can be adjusted on the basis of the temperature detected by the sensor. At a position of the piping 52 downstream of the heater 56, the piping 52 bifurcates so as to be connected to the portion near the introduction side of the color developing tank 12 and to the portion near the discharge side of the color developing tank 12.

One end of a piping 58 is connected to a portion of the piping 52 at the ream side of the pump 54. The other end of the piping 58 is connected to a replenishing tank 60 in which replenishing solution is stored. A pump 62, for sending replenishing solution in the replenishing tank 60 into the piping 52, is disposed on the path of the piping 58. Accordingly, the heater 56 also heats the replenishing solution which is sent by the pump 62.

An example of a color negative film has been described according to the present embodiment. However, in the same way as the present embodiment, processing of black and white film can be effected by using the color developing tank 12 as a developing tank and the bleaching/fixing tank 14 as a fixing tank. Processings of APS film, color reversal film and the like can be effected as well.

Next, assembly of the photosensitive material processing device 10 of the present first embodiment will be described.

Figure 5:
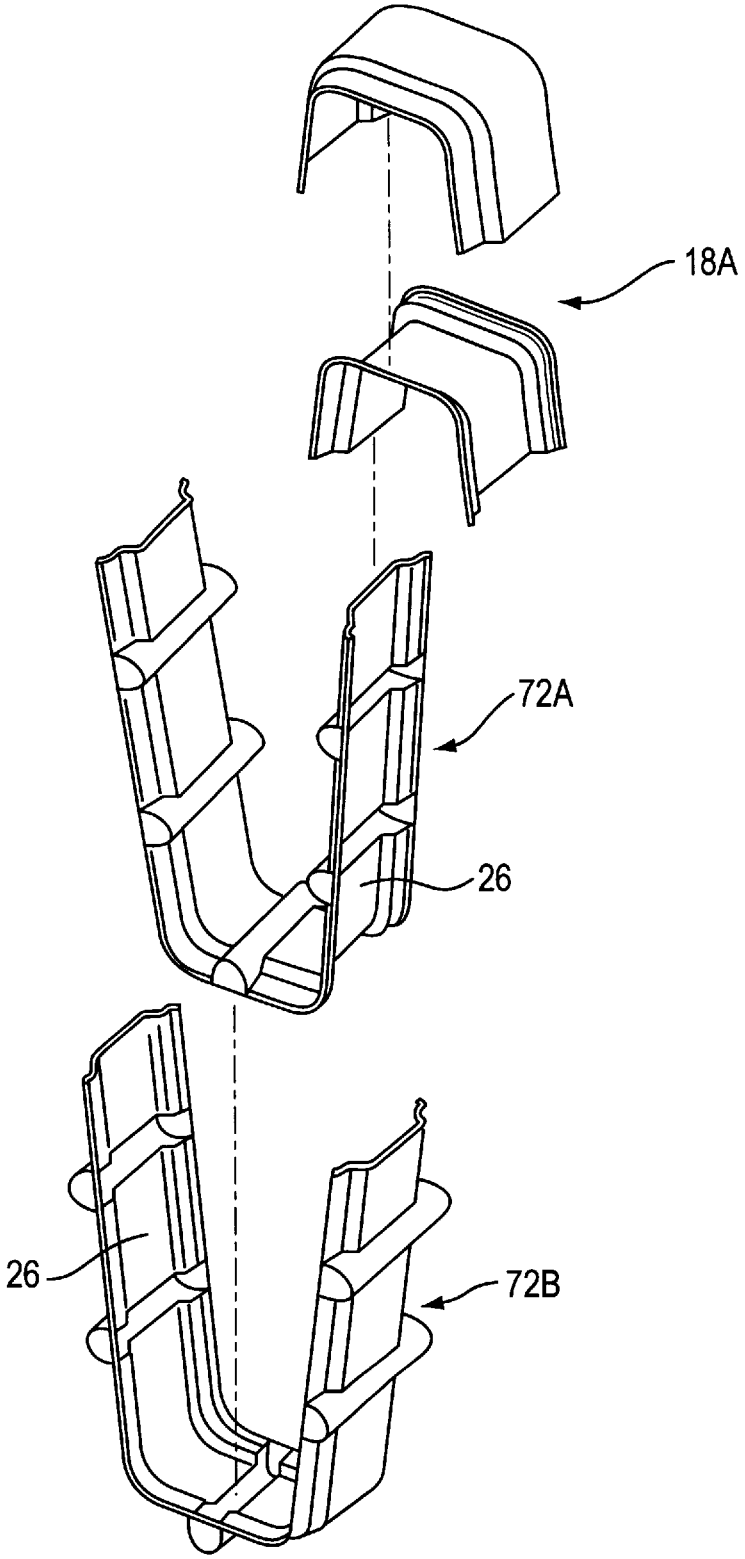
FIG. 5 is an exploded view of the color developing tank and a connecting member according to the present embodiment.

First, as illustrated in FIG. 5, a pair of plate-shaped tank forming members 72A, 72B as structural member are formed by injection molding. The tank forming members 72A, 72B are each formed in a U-shape. The concave portion 26, which is a transverse direction central portion and which extends in a groove-shape along the longitudinal direction, is formed in each of the tank forming members 72A, 72B.

With the pairs of conveying rollers 30 placed in the respective swelled portions of the tank forming members 72A, 72B which are to become the bulging portions 28, the pair of tank forming members 72A, 72B are adhered and joined together such that the concave portion 26 sides thereof oppose one another. In this way, the U-shaped color developing tank 12 is formed.

The bleaching/fixing tank 14 and the stabilizing tanks 16 are formed in the same way as described above. The connecting members 18A, 18B, 18C, 18D are also formed by joining together unillustrated pairs of members which are similarly formed by injection molding.

Thereafter, the color developing tank 12, the bleaching/fixing tank 14, the stabilizing tanks 16, and the connecting members 18A, 18B, 18C, 18D are assembled. The transmission rollers 34 are disposed so as to correspond to the bulging portions 28, and the chain 44 is entrained about the sprockets 42 of the transmission rollers 34. In the same way as the pipings 52, 58 to the color developing tank 12, pipings are connected to the bleaching/fixing tank 14 and the stabilizing tanks 16, so as to enable the circulation of the processing solutions such as the color developing solution and the addition of the replenishing solution. The photosensitive material processing device 10 is thereby completed.

Next, with reference to FIG. 8, a description of a method of manufacture and assembly of each of the processing tanks according to a first variant example will be given, hereinafter.

Figure 8:
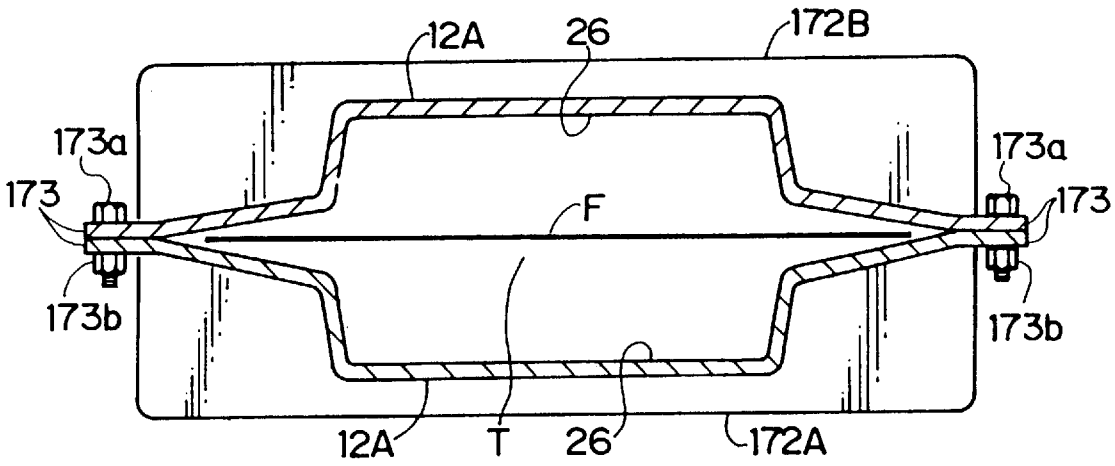
FIG. 8 is a view of a first variant example of a photosensitive material processing device.

FIG. 8 is a transversely cross-sectional view of a portion between the bulging portions 28 adjacent to one another along the longitudinal direction of each tank, which is a portion corresponding to a concave portion 26.

A pair of tank forming members 172A, 172B, which form each tank such as the color developing tank 12, include ribs 173 projecting outwardly from the end portions of each of the tank forming members 172A, 172B in the transverse direction thereof. Other portions of the tank forming members 172A, 172B excluding the ribs 173 have the same configurations as those of the tank forming members 72A, 72B in FIG. 5. In the same manner as the tank forming members 72A, 72B in FIG. 5, the tank forming members 172A, 172B are formed by injection molding. Through holes are provided in the ribs 173 at a predetermined interval in the longitudinal direction of each of the tank forming members 172A, 172B. The assembly of the tank forming members 172A, 172B is effected such that the tank forming members 172A, 172B are opposed one another at the sides of the concave portions 26 by a packing interposed between the tank forming members 172A and 172B as requested and are fastened to each other by bolts 173*a* and nuts 173*b* via the above through holes.

Figure 9:
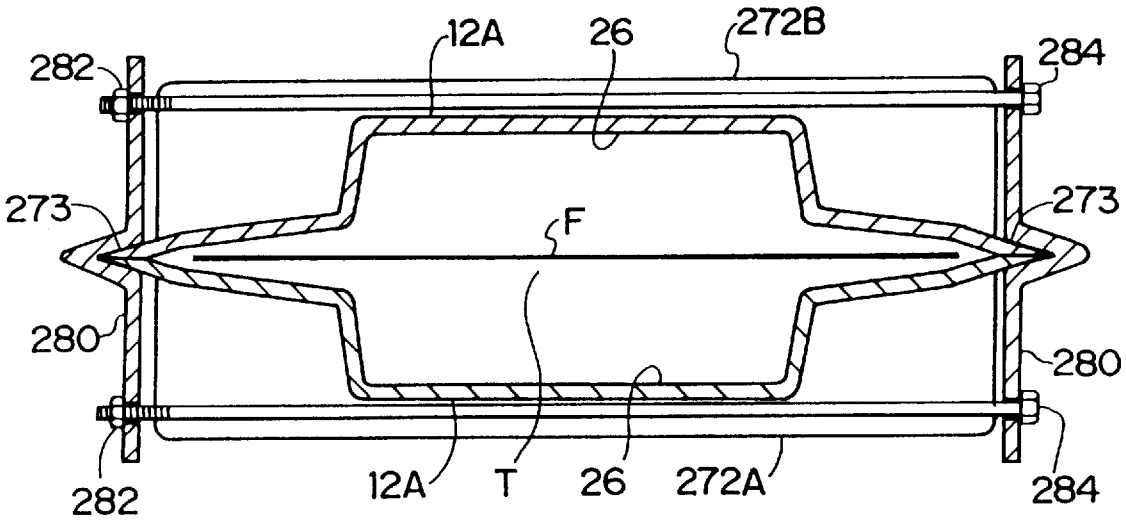
FIG. 9 is a view of a second variant example of each tank in a photosensitive material processing device.
Figure 10:
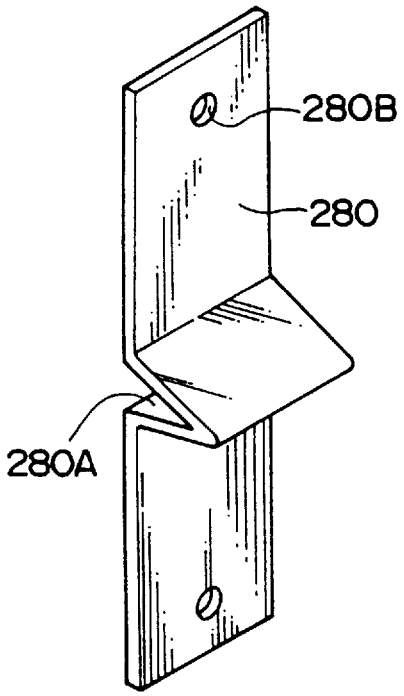
FIG. 10 is a perspective view of a bracket used in the second variant example in FIG. 9.

With reference to FIGS. 9 and 10, a description of a method of manufacture and assembly of each processing tank according to a second variant example will be given, hereinafter. FIG. 9 is a transversely cross-section al view of a portion provided between the bulging portions 28 adjacent to one another in the longitudinal direction of each tank, which is a portion corresponding to the concave portion 26.

A pair of tank forming members 272A, 272B, which form each of the processing tanks such as the color developing tank 12, include ribs 273 projecting outwardly from the end portions of each of the tank forming member s 272A, 272B in the transverse direction of the tank. Being different from the ribs 173 in the above first variant example, each of the ribs 273 is tapered toward a tip portion thereof. Other configurations of the tank forming members 272A, 272B excluding the ribs 273 are the same as those of the tank forming members 72A, 72B in FIG. 5. In the s am e manner as the tank forming members 72A, 72B in FIG. 5, the tank forming members 272A, 272B are formed by injection molding. A plurality of brackets 280 are provided to connect the tank forming members 272A, 272B to each other. As shown in FIG. 10, each of the brackets 280 is formed in a substantially rectangular-shape and has a concave portion 280A bending at the central portion of the bracket 280 and extending along the transverse direction of the bracket 280. When the tank forming members 272A, 272B are caused to abut on each other so as to form a pair of the ribs 273 and the ribs 273 thus paired are inserted into the concave portion 280A, the transverse cross-section of the concave portion 280A is formed in a V-shape so as to clamp the pair of the ribs 273. Holes 280B for passing bolts therethrough are formed in each of the brackets 280. The assembly of the tank forming members 272A, 272B is effected such that the tank forming members 272A, 272B are opposed one another at the sides of the concave portions 26 and as necessary, a packing 274 is interposed therebetween. Thereafter, each of the brackets 280 is corresponded to the paired ribs 273, respectively at the end portions of the tank forming members 272A, 272B in the transverse direction thereof so as to fasten the paired brackets 280 by bolts 282, each of which has a long shaft portion, and nuts 284.

Further, in the above first and second variant examples, the ribs may be formed so as to extend along the whole portion of each of the tank forming members in the longitudinal direction thereof, or the ribs may be formed so as to be separated from each other at suitable distances along the longitudinal direction of each tank forming member.

Figure 13:
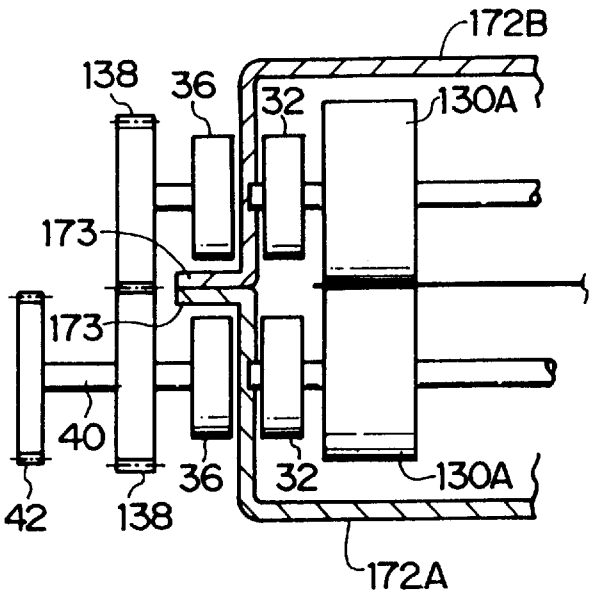
FIG. 13 is a view of a driving method of the conveying rollers according to the first variant example.

A driving method of the conveying rollers which has been described with respect to FIG. 4 can be adopted for a driving method of rollers for conveying a photosensitive material disposed at the bulging portions which are described in the above first and second variant examples. More specifically, a description of a driving method in the first variant example will be given with reference to FIG. 13. In this figure, portions and/or parts identical to those shown in FIG. 4 are denoted by the same reference numerals and a description therefor will be omitted. The distance between a pair of conveying rollers 130 must be made larger than that in FIG. 4 because each of the ribs 173 is provided at the end portions of the tank forming members 172A, 172B. Accordingly, a driving wheel 130A of each of the conveying rollers 130 has a larger diameter than that of the driving wheel in FIG. 4. In the same way, a gear 138 has a larger diameter than the gear 38 in FIG. 4. Other structures of conveying rollers 130 in a driving method in FIG. 13 are the same as those of the conveying rollers 30 in FIG. 4.

In FIG. 5 and the above first and second variant examples, it is preferred that each of the tank forming members 72A, 72B has a configuration, or longitudinal dimension, in which each of the tank forming members is cut at a position which is higher than the uppermost one of a plurality of the bulging portions 28.

Figure 11:
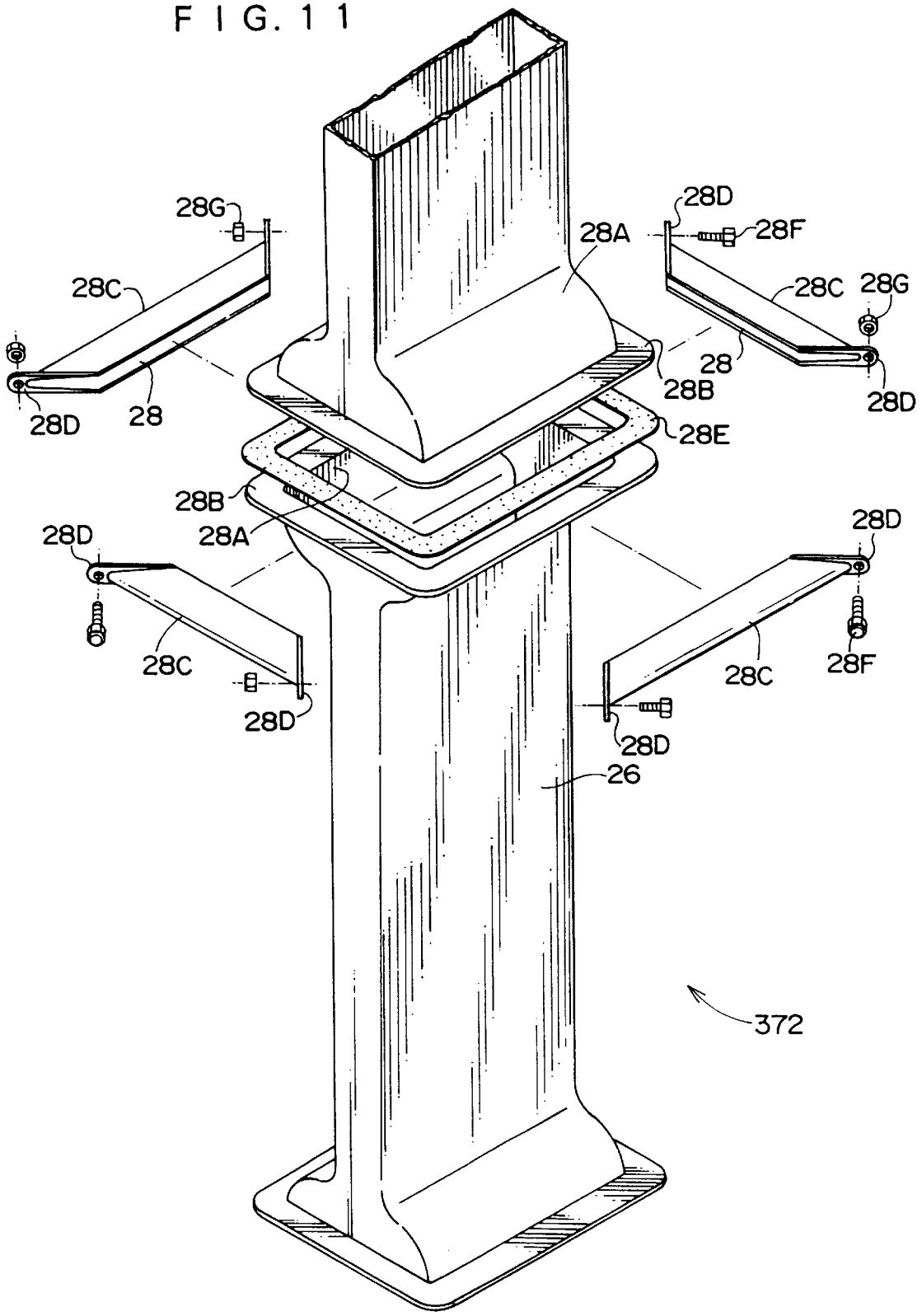
FIG. 11 is a view of a third variant example of each tank in the photosensitive material processing device.
Figure 12:
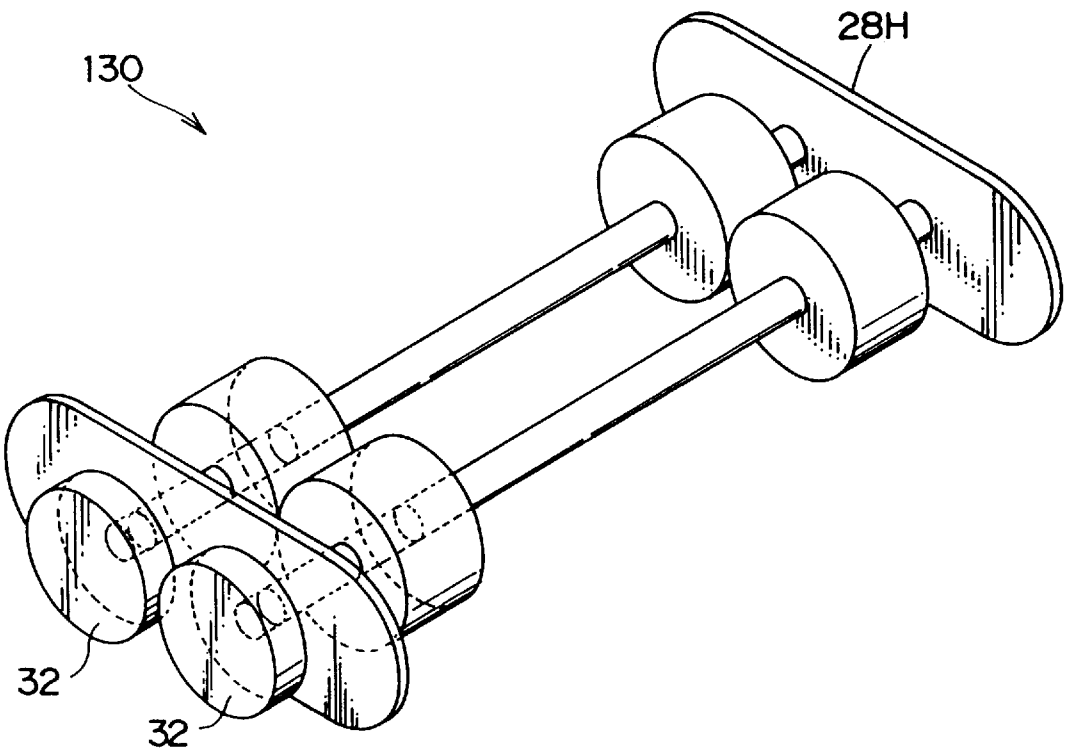
FIG. 12 is a view of conveying rollers used in the third variant example in FIG. 11.

With reference to FIGS. 11 and 12, a description of a method of manufacture and assembly of each of the processing tanks according to a third variant example will be given, hereinafter.

As shown in FIG. 11, a structural member constituting each tank and/or a conveying path for conveying a photosensitive material is formed in a cut-shape in which it is cut at the central portion of each of the bulging portions 28 adjacent to one another along the conveying direction of a photosensitive material. A structural member 372 has a substantially rectangular and tubular configuration and the intermediate portion of the structural member 372 along the longitudinal direction of each of the tank forming members corresponds to the concave portion 26 of the groove-shape. An enlarged diameter portion 28A, or a half of the bulging portion 28, which is formed in a semi-elongated circular shape as seen from a side view is formed by both end portions of the structural member 372 in the longitudinal direction of the tank forming member so as to correspond to the bulging portions 28. Rib 28B is projected from the end edge portion of each of the enlarged diameter portions 28A. Four fastening members 28C correspond to sides of the rib 28B, respectively. Each of the fastening members 28C has convex portions 28D having an opening for passing a bolt therethrough at each longitudinal end portion of the fastening member 28C.

Next, a description of the assembly of the above members will be given. Two structural members 372 are pressed to each other vertically with a packing 28E interposed therebetween. The four fastening members 28C are fitted onto four sides of the ribs 28B paired, respectively and the two fastening members 28C adjacent to each other are fastened by bolts 28F and a nut 28G. Before two structural members 372 are assembled, as shown in FIG. 12, a pair of conveying rollers 130 are provided at the enlarged diameter portions 28A in a state in which the rollers have been mounted to brackets 28H, each of which is formed so as to correspond to the shape of the inner peripheral surface of the enlarged diameter portions 28A assembled, or the bulging portion 28 and a magnet 32 has been mounted to an end portion of each of the shaft portions of the conveying rollers 130.

In each of the above first, second and third variant examples, a rib which is formed at each of the structural members for constituting each tank is used and the assembly of the structural members is effected by fastening the structural members by fastening members. In the above variant examples, bolts and nuts are used as fastening members. However, other fastening members such as clips or the like can be used to fasten or assemble the structural members to each other. Since each of the processing tanks of the photosensitive material processing device is structured as a unit, the improvement of the capacity of the processing device and the maintenance thereof can be facilitated.

Next, operation of the present embodiment will be described.

The tank volume of the color developing tank 12 which stores the color developing solution is V milliliters. The path length, which is the conveying length from the position at which the color negative film F begins to contact the color developing solution within the color developing tank 12 to the position at which the color negative film F is discharged from the color developing solution is L cm. The color developing tank 12 is formed such that the value of V/L is 25 or less. Further, the color developing tank 12 is formed from a crystalline resin.

Accordingly, even though the color developing tank 12 is long and narrow and has a V/L value of 25 or less, the color developing tank 12 is formed from a crystalline resin. Therefore, slidability between the guide portions 12B which guides the color negative film F and forms a conveying path T for the color negative film F, and the color negative film F which is a silver halide photosensitive material, increases, and accordingly, conveyability of the color negative film F in the color developing tank 12 increases. The color negative film F is conveyed along the conveying path T by the conveying rollers 30.

Further, because the value of V/L is 25 or less, as compared with a conventional color developing tank 12, the amount of color developing solution can be reduced, there is no need for a large amount of replenishing solution in order to maintain the characteristics of the color developing solution, and the operating cost of the photosensitive material processing device 10 can be reduced. Further, by reducing the amount of color developing solution in accordance with the above-described structure, the color developing tank 12 which stores the color developing solution can be made compact, and accordingly, the photosensitive material processing device 10 can be made compact.

The present embodiment is structured such that the substrate FB of the color negative film F is made from polyethylenenaphtalate and the magnetic writing layer FM is formed thereon. Therefore, in addition to the above described conveyability of the color negative film F, because the substrate FB of the color negative film F is made from high strength of polyethylenenaphtalate, the surfaces of the color negative film F are not easily damaged by abrasion or the like. Accordingly, reading accuracy of magnetic information on the magnetic writing layer FM is improved.

Further, because a thickness t of the substrate FB of the color negative film F is thinned to be less than or equal to 100 $\mu$m, flexibility of the color negative film F is also increased in conformity with the above thickness by which the substrate FB has been thinned. Accordingly, even in the color developing tank 12 which is long and narrow and has a value V/L of 25, the color negative film F is bent so as to be conveyed with less problems.

Meanwhile, the other processing tanks such as the bleaching/fixing tank 14 and the stabilizing tanks 16 having a value V/L of 25 or less can operate in the same way as the color developing tank 12.

In the present embodiment, the temperature of the color developing solution is 45° C. The temperatures of the bleaching/fixing solution and washing water are 40° C. The processing rate of the color negative film F can be adjusted such that when the color negative film F is immersed into each of the processing solutions, the film F is immersed for 60 seconds per one processing solution. For example, the conveying rate of the color negative film F is between 0.1 m/min and 5 m/min. The gap D between the color negative film F and the inner wall surface of each of the processing tanks such as the color developing tank 12 or the like, which is shown in FIG. 6, is between 0.1 cm and 10 cm.

Examples of the crystalline resin in the above-described embodiments are PE (polyethylene), PP (polypropylene), PA (polyamide), POM (polyacetal), PBT (polybutylene terephthalate), PET (polyethylene terephthalate), PPS (polyphenylene sulfide), fluoroplastics (PTFE (polytetrafluoroethylene), PFA (polytetrafluoroethylene/perfluoroalkylvinylether copolymer), FEP (polytetrafluoroethylene/hexafluoropropylene copolymer), ETFE (ethylene/polytetrafluoroethylene copolymer), PCTFE (polychloridetetrafluoroethylene), ECTFE (ethylene/polychloridetetrafluoroethylene copolymer), PvdF (polyvinylidene fluoride), PvF (polyvinylfluoride)), and the like.

These resin materials are particularly suited for the guide portions 12B and portions at the liquid surface where it is easy for the processing solution (e.g., color developing solution) to precipitate. Further, the processing tanks may be formed by these resin materials by injection molding or the like. The above-described fluorides may be used as a surface treatment material such as a coating or a lining or the like on another material such as PPE or the like. The effects can be exhibited in this way as well.

As described above, a photographic developing machine, which is a photosensitive material processing device, having a LVTT (Low Volume Think Tank) type of a processing tank, stores a small amount of processing solution in the processing tank, has excellent resistance against a deterioration factor such as oxidization, evaporation or the like, and can minimize the size of the processing tank as compared with the processing capability of the processing tank so that the photographic developing machine itself can be made compact.

Conventionally, from a viewpoint of the durability of a material of a tank for a processing tank, an amorphous resin such as polyvinyl chloride resin, PPO or the like has been used so often.

However, in a LVTT type of the processing tank according to the present invention, the size of the processing tank can be minimized and even when the processing tank is formed from a crystalline resin, dimensional changes such as spreading, warpage and the like can be reduced so that the level in which the processing tank is put to practical use can be achieved. The forming mold used for the processing tank is made compact, the processing tank is manufactured accurately and dimensional accuracy of the processing tank is thereby increased. Accordingly, because the thickness of the tank can be reduced over that of the conventional tank, a drive force transmitting mechanism in the photographic developing machine by magnetic coupling from outside of the processing tank, which has been difficult for the conventional processing tank, is allowed to be put to practical use. Roller components are also allowed to be assembled into or mounted to tank members.

By utilizing a LVTT type of the processing tank as the photographic developing tank which stores a small amount of processing solution, maintenance and management of the quality of a photograph can be improved and significant effects can be exhibited in design and manufacturing of the photographic developing machine.

Conventionally, although there have been less problems in friction or abrasion, an amorphous resin could not be used for the processing tank because of the dimensional accuracy and/or the manufacturing ability. However, as described above, in recent years, because it becomes possible to use the amorphous resin, a countermeasure for preventing the tank from being damaged by abrasion or the like is improved and significant effects are exhibited in manufacturing of the tank in the photographic developing machine.

The processor which is the photosensitive material processing device 10 relating to the embodiments of the present invention can utilize any of various types of conveying methods other than that of the above-described embodiments. Various conveying methods will be described hereinafter.

So-called drum processing, in which a photosensitive material is, by the rotation of a drum, inserted, conveyed and sent out from processing solution filled into a narrow gap, is known as a conveying mechanism ("Photograph Industry" ("Shashin Kogyo"), December 1974, p. 45). In this method, the photosensitive material which is the color negative film F is developed by using the inner wall or the outer wall of the drum. The outer wall type is preferable from the standpoint of ease of manufacturing a processing tank device holding a small amount of solution.

Roller conveying-type processors are known which convey photosensitive materials by the nip force of rollers such as opposing rollers, staggered rollers or the like ("Photograph Industry" ("Shashin Kogyo"), February 1975, p. 71).

This method is preferably used in the present invention from the standpoint of ease of manufacturing a small device. Further, it is even more preferable to use a method in which a groove through which the photosensitive material passes is provided and the conveying route is controlled, as disclosed in Japanese Patent Application Laid-Open (JP-A) No. 4-95953. This method is appropriate for the conveying of photosensitive materials having a thick substrate. The opposing roller type is preferable for photosensitive materials having a thin substrate.

Moreover, when photosensitive materials having a thin substrate are to be conveyed, it is preferable to provide many pairs of opposing rollers or to join the photosensitive material to the trailing end of a thick substrate (also called a tab leader) and to process the photosensitive material in this manner. Depending on the case, a feed mechanism (insertion mechanism) may be provided at the insertion portion of the processing tank.

On the other hand, in a processing tank such as the LVTT type of the present invention, because a cross section of the tank is considerably small, it is quite difficult to house therein a drive force transmitting mechanism such as a chain, a gear or the like as a drive system. However, by mounting the drive force transmitting mechanism at an outer side of the processing tank, it is possible to satisfy the original purpose of the LVTT type tank.

In this case, roller shafts in the processing solution must be inserted into the outside and inside of the processing solution and a sealed solution is thereby needed. However, because a material structure used for the sealed solution in the atmosphere of the photographic processing solution is extremely complicated, the magnetic coupling in the above present embodiment is the most suitable method for the drive force transmitting mechanism. The magnetic coupling is effected by disposing the processing tank between magnets and wall portions of the processing tank. By this magnetic coupling, the drive force transmitting mechanism is effected at an outer side of the processing solution and conveying rollers are driven in the processing solution so that they do not contact one another. By applying this magnetic coupling to the present invention, excellent effects can be accomplished.

There exist methods in which a photosensitive material is processed by joining an exposed photosensitive material to the trailing end of a leader, which has been passed in advance into the processing tank, and driving is carried out so that the leader is taken up. For photographed photosensitive materials, this method is known as cine-type developing, and for printed photosensitive materials, this method is known as leader-trailer conveying developing ("Photograph Industry" ("Shashin Kogyo"), March 1975, page 70; April 1975, page 40; May 1975, page 36; June 1975, page 41).

In these processing methods, it is necessary to attach elongated leaders to the leading end and the trailing end of the photosensitive material and process the photosensitive material. These methods are applicable to cases in which it is necessary to produce a large amount such as print materials.

Similar conveying methods are an endless leader belt method and an endless chain method ("Photograph Industry" ("Shashin Kogyo"), May 1975, page 36; June 1975, page 41).

However, in these methods, much solution is taken out and brought in, and therefore, these methods are not appropriate for the present invention.

Among methods in which an exposed photosensitive material is attached to the trailing end of a leader which has been passed in advance into the processing tank, recently, a method has been used in which the leader is not elongated but is short (and hence called a "short leader"), and the short leader is moved by a special driving. Such a method is applicable to the present invention, and is one preferable aspect.

In this method, the short leader is moved by the rotation and movement of a belt (timing belt) having a plurality of convex portions corresponding to holes formed in the short leader, and as a result, the photosensitive material is processed.

In another method, the short leader is moved by the rotation of a gear (or sprocket) having convex portions corresponding to holes formed in the short leader, and the photosensitive material is processed. An example of this method is disclosed in Japanese Patent Application Laid-Open (JP-A) No. 4-101139.

This method is one preferable conveying method. In particular, the method of conveying by using a sprocket is preferable.

Methods of processing by using a small amount of solution such as in the present invention include a belt conveying method, an endless belt method, a magnetic conveying method, a sprocket conveying method and the like. Belt conveying methods are disclosed in Japanese Patent Application Laid-Open (JP-A) No. 2-67551 and Japanese Patent Application Laid-Open (JP-A) No. 2-103043. Endless belt methods are disclosed in Japanese Patent Application Laid-Open (JP-A) No. 2-67550 and Japanese Utility Model Application Laid-Open (JP-U) No. 2-58744. A magnetic conveying method is disclosed in Japanese Patent Application Laid-Open (JP-A) No. 1-154155. A sprocket conveying method is disclosed in Japanese Patent Application Laid-Open (JP-A) No. 4-101139.

It is preferable that the processing solutions be circulated in the processing tanks of the present invention for temperature control and the removal of suspended matter. The speed of the circulation depends on the size of the processing tank and is 0.1 to 30 liters per minute, and preferably 0.2 to 10 liters per minute. If the circulation is too weak, it is difficult to control the temperature, whereas if the circulation is overly strong, the solution may deteriorate or overflow.

It is preferable that the circulation method applied to the present invention is a method in which the circulating system sucks in processing solution from the bottom portion of the processing tank, and discharges processing solution into the upper portion of the tank. Here, the upper portion of the tank means a position which is at a depth of 10 cm or less from the surface of the solution. It is particularly preferable to discharge solution at this position. Further, in order to prevent the overflow of solution due to pressure at the upper portion of the liquid surface, a method of covering the vicinity of the liquid surface by a wiper blade or the like may preferable be used. This wiper blade may simultaneously be used as a squeegee.

Magnet pumps MD-10, MD-20, MD-30 manufactured by Iwaki Co. are preferably used as the pump.

Jet openings which strongly jet solution may be provided at the circulating system (jet agitation). The jetted solution contacts the film surface of the photosensitive material so that the desired photographic characteristic are obtained in a short time, the desilverizing speed is increased, and the washing away of various components in the water washing baths and stabilizing baths is accelerated.

Methods of jet agitation are disclosed in Japanese Patent Application Laid-Open (JP-A) Nos. 3-41447, 4-83251, 5-11421, 5-224382, 5-281688, 7-199436 and the like.

A method of jet agitation in processing solutions is disclosed in Japanese Patent Application Laid-Open No. 62-183460, page 3, lower right column through page 4, lower right column in the "Examples". This method is a method of emitting solution which is force-fed by a pump from nozzles provided so as to oppose the emulsion surface, and is a preferable method.

Magnet pumps MD-10, MD-15, MD-20 or the like manufactured by Iwaki Co. can be used as the pump. The nozzle hole diameter is 0.3 to 2 mm, and preferably 0.5 to 1.5 mm. It is preferable that the nozzles are formed as circles and are set as orthogonally as possible with respect to the surface of the chamber plate and the surface of the photosensitive material. However, an angle of 60 degrees to 120 degrees from the conveying direction and a rectangular or slit-shaped configuration may also be used. The number of nozzles is, per 1 liter tank volume, 5 to 200 and preferably 10 to 100.

When the jetted flow hits only a portion of the photosensitive material, developing irregularities or residual-color irregularities are generated. Therefore, it is preferable to successively offset the positions of the nozzles so that solution is not jetted to the same place. For example, the positions of hole rows of 2 to 8 holes may be changed slightly at appropriate intervals perpendicularly to the conveying direction. If the distance from the nozzles to the photosensitive material is too short, it is easy for the aforementioned irregularities to occur, whereas if the distance is too far, the agitating effect weakens. The distance is preferably 0.5 to 12 mm, and more preferably 1 to 9 mm.

The rate of flow of the solution emitted from the nozzles is similarly in an optimal range, and is preferably 0.5 m/sec to 5 m/sec, and rates of flow of 1 m/sec to 3 m/sec are particularly preferable.

It is preferable that the processing apparatus of the present invention has a function for replenishing in accordance with the amount of the exposed photosensitive material which is processed.

Any of various methods of replenishing can be used. The following are examples of methods which may be used. Japanese Patent Application Laid-Open (JP-A) No. 5-173299 discloses a method of replenishing a direct concentrated liquid of a replenishing system. Japanese Patent Application Laid-Open (JP-A) No. 6-194811 discloses a method in which concentrated liquid is stocked in a stock tank and thereafter replenished. Japanese Patent Application Laid-Open (JP-A) Nos. 64-55560, 64-55561, and 64-55562 disclose methods for replenishing complete solution which replenish complete solution directly to a processing tank from a complete solution cartridge. Japanese Patent Application Laid-Open (JP-A) No. 3-134666 discloses a method of automatically supplying replenishing solution to a stock tank from a cartridge, and thereafter, replenishing the processing tank. EP-590583A1 discloses a method of replenishing concentrated liquid and water directly to a processing tank. Japanese Patent Application Laid-Open (JP-A) Nos. 5-188533, 6-202297, and 7-169339 disclose methods of replenishing a solid processing agent and water.

In the processing apparatus of the present invention, because the opening surface area of the liquid surface is relatively small, it is preferable to provide a circulating system and a subtank and to replenish solution to these portions. Further, when solution is to be replenished to the circulation system, it is preferable to provide a bulge at one portion of the circulation path (a hump tank) and to replenish solution to this portion.

A replenishing pump is used to replenish the processing solution, and it is preferable to use a bellows-type replenishing pump. As a method of improving the replenishing accuracy, it is effective to make the diameter of the solution feed tube to the replenishing nozzle narrow in order to prevent backflow at the time the pump is stopped. The inner diameter of the solution feed tube is preferably 1 to 8 mm, and 2 to 5 mm is especially preferable.

Although various types of materials for parts may be used in the automatic developing device which is the photosensitive material processing device of the present invention, the following materials are preferable.

In addition to the crystalline resins described previously, modified PPO (modified polyphenylene oxide) and modified PPE (modified polyphenylene ether) resin are preferable for use as the material of the processing tank. An example of the modified PPO is "NORYL" manufactured by Nippon GE Plastic Co., and examples of the modified PPE are "XYRON" manufactured by Asahi Chemical Industry Co., Ltd. and "IUPIACE" manufactured by Mitsubishi Gas Chemical Company, Inc. These materials have superior chemical resistance with respect to color developing solutions, fixing solutions, bleaching/fixing solutions, and the like. These materials are appropriate for injection molding and are advantageous in that they can be used for low ratio expansion molding and various types of blow molding such as cinpres molding and gas counter pressure molding. Integral molding of guides or racks of the processing tanks is possible by using these molding methods. Because these materials have a higher heat-resistant temperature than general ABS, the materials can be used for the material of the drying portion of the automatic developing apparatus as well. When more heat-resistance and rigidity are needed, a glass-fiber-strengthened grade or a filler-added grade can be used.

Because ABS (acrylonitrile butadiene styrene resin) is chemical-resistant with respect to processing solutions (e.g., color developing solution, bleaching solution, fixing solution, bleaching/fixing solution), ABS can be used for portions of the tank or for the racks or the like. "Denka" manufactured by Denki Kagaku Kogyou Co., "Cycorack" manufactured by Ube Kosan Co., and ABS resins manufactured by various companies such as Mitsubishi Monsanto Kasei and Nippon Gosei Gomu can be used. It is preferable that ABS is used in an environment of less than or equal to 80° C. Further, ABS molds well by injection molding, and can be molded with good planarity and with few sink marks during molding. Therefore, ABS is a material which is suitable for the housing of the automatic developing apparatus, and is suitable for the supply portions and the cassettes of the processor.

PE (polyethylene) and PP (polypropylene) which are olefin base resins have good chemical resistance with respect to processing solutions (e.g., color developing solution, bleaching solution, fixing solution, stabilizing solution). There are many types of manufactured PE, such as those manufactured by Showa Denko, Ube Kosan, and the like. There are many types of manufactured PP, such as those manufactured by Ube Kosan, Chisso, Mitsui Toatsu Kagaku, Asahi Chemical Industry Co., Ltd., and the like. PE and PP are used as materials for the replenishing tanks and the waste liquid tanks in the automatic processing device. Because these materials are inexpensive and can be used to easily make a large tank by blow molding, these materials are preferably used for regions which do not require high dimensional accuracy.

PVC (polyvinylchloride resin) has excellent chemical-resistance, is inexpensive, and has superior processability as it can be welded easily.

In addition to PVCs manufactured by Denki Kagaku Kogyo and Riken Vinyl Kogyo, many other companies such as mold manufacturers and the like manufacture various PVCs. Plate materials which are extrusion molded from Dakiron Kogyo's "Dakiron Plate" and Mitsubishi Jushi's "Hishi Plate" are sold. Further, various types of modified PVCs are sold and can be used easily. Tubular plastic "Kaiduc" and products from Sun Arrow Kagaku and the like are sold as acryl-modified PVCs. The surfaces of acryl-modified PVCs finish smoothly and are water-repellent. Acryl-modified PVCs are suitable materials for the tanks because it is difficult for processing solutions to precipitate thereon (e.g., precipitation of chemicals from a color developing solution). As a means of making the surface of a PVC extrusion-molded product or PVC injection-molded product smooth, in addition to the modified PVC, adding soybean oil or the like in order to improve the flowability during molding is very effective. The addition of soybean oil (particularly modified soybean oil) makes the resin surface smooth, does not deteriorate the quality of the photosensitive material by scratching or the like, and improves the flowability during molding.

Crystalline polymers can be used as the material for the processing tank and the processing portion guides in order to improve the conveyability of the photosensitive material and as a measure against the precipitation of color developer chemicals or the like. PBT (polybutyleneterephthalate), HDPE (ultra high density polyethylene resin), PTFE (polytetrafluoroethylene resin), PFA (polytetrafluoroethylene perfluoroalkoxyethylene resin), PVDF (polyvinylidene fluoride resin) and the like are suitable for use as the material for the guides which the photosensitive material contacts and for the liquid surface portions at which it is easy for the processing solution (e.g., color developing solution) to precipitate. Effects are achieved even if the aforementioned fluorides are used as a coating for other materials such as PPE or the like.

Thermoplastic resins such as PVC (polyvinylchloride), PP (polypropylene), PE (polyethylene), UHMPE (ultra high molecular weight polyethylene), TPX (polymethylpentane), PPS (polyphenylene sulfide), modified PPO (modified polyphenylene oxide), modified PPE (modified polyphenylene ether), and the like are appropriate for use as the material of the rollers of the processing section.

Olefin base resins such as PP, PE, TPX and the like allow the roller surface to be injection molded smoothly, and allow the rotational load to be made small as the specific gravity thereof is low. Therefore, it is difficult for the emulsion surface of the photosensitive material being conveyed to be damaged, and these olefin base resins are suitable for use. Olefin base resins are often used for drum rollers of turn portions or the like. Materials such as UHMPE and PTFE (including PFA and PVDF) are suitable for portions at which the photosensitive material slides and portions at which processing solution repellence is required. Damage to the photosensitive material caused by precipitates of the processing solution adhering to and hardening at the rollers can be prevented. Rollers having these materials at the roller surfaces (including rollers which are coated with these materials) are suited for use as rollers positioned at the liquid surface of the processing solution or rollers at the squeeze portion.

PVC is easy to process into rollers by extrusion molding and is therefore suitable. Rollers having a soft resin portion at the surface thereof can be easily manufactured by double extrusion processing, and it is preferable that the photosensitive material is contacted by a soft touch. In addition to PVC, modified PPO, modified PPE, modified PPS and the like have high rigidity and can withstand high rotational torque, and therefore are suitable for use for rollers having conveying force. In order to further increase the rigidity of these materials, it is preferable to use fiberglass reinforcing or to use reinforcing agents to which minerals such as mica, talc, titanium acid, potassium or the like are added. By adding a reinforcing substance, the bending modulus of elasticity of the rollers improves, creep deformation due to changes over time can be prevented, the rollers do not bend due to long-term use, and a stable conveying performance can be ensured. By adding inorganic matter to the resin, the surface of the roller is made to have a slightly rough texture by the inorganic matter particles appearing on the surface of the roller, so that slippage of the photosensitive material being conveyed can be prevented. At this time, the roller surface roughness is controlled by adjusting the particle diameter and the added amount of the added inorganic matter.

Thermoset resins are suitable for conveying rollers whose diameters are small and conveying rollers whose lengths are long for photosensitive materials which are wide. For example, PF (phenol resin), thermoset urethane resin, and unsaturated polyester resin are preferable. Epoxy resins are suitable for certain processing solutions other than alkaline processing solutions. Resol base PFs are preferable, and "OR-85" manufactured by Mitsui Toatsu Kagaku is particularly suitable. Graphite may be added for reinforcement. Because these rollers can be made thin (e.g., an outer diameter of 8 mm), the processing rack can be made compact. Nippon Unipolymer's "Uniron", Dainippon Inki Kagaku Kogyo's "Pandex", Takeda Yakuhin Kogyo's "Takenate" and the like are suitable for the thermoset urethane resin.

Rollers covered with a fluorine base resin film are preferable from the standpoint of preventing staining caused by the color developing solution. More specifically, the resins disclosed in Japanese Patent Application Laid-Open (JP-A) No. 4-161955 or the like may be used.

Elastomers may be used at soft rollers such as nip rollers. For example, olefin base elastomers, styrene base elastomers, urethane base elastomers, PVC elastomers and the like are preferable.

The following thermoplastic crystalline resins are suited for the gears and sprockets of the processing portion: PA (polyamide), PBT (polybutylene terephthalate), UHMPE (ultra high molecular weight polyethylene), PPS (polyphenylsulfide), LCP (aromatic polyester resins, liquid crystal polymers), PEEK (polyether etherketone), and the like.

PA includes, in addition to polyamide resins such as 66 nylon, 6 nylon, 12 nylon and the like, modified polyamides and aromatic polyamides having an aromatic ring in the molecular chain. Examples of the 66 nylon and the 6 nylon are "Zytel" by Toray and Dupont, and examples of the 12 nylon are "Rirusan" by Toray and "Diamide" by Dycell Hurus. Mitsubishi Gas Chemical Company, Inc.'s "Reni" polyamide MXD6 is suitable for the aromatic polyamide, and Mitsui Petrochemical Industries, Ltd.'s "Allene" modified polyamide 6T is suitable for the modified polyamide. It is preferable that the PA is a fiberglass reinforced or carbon fiber reinforced grade because PAs swell easily in the processing solution because the absorption ratio thereof is high. Because aromatic polyamides have a relatively low absorption ratio, it is difficult for aromatic polyamides to swell, and high dimensional accuracy can be obtained. High molecular weight articles such as MC nylon obtained by compression molding exhibit sufficient performances even if not fiber reinforced. Oil-containing nylon resins such as "polyslider" can also be used.

In contrast to PA, PBT has an extremely low absorption ratio, and therefore, has good chemical resistance to processing solutions. PBTs manufactured by Toray and Dainippon Inki Kagaku Kogyo as well as "Barox" manufactured by Nippon GE Plastics can be used. Fiberglass reinforced PBTs and unreinforced PBTs are used in accordance with the region. In order to improve the meshing of gears, it is preferable to use a fiberglass reinforced PBT in combination with an unreinforced PBT.

Unreinforced UHMPEs are suitable. Examples of suitable UHMPEs are "Ryubuma" and "Hi-Zexmilion" by Mitsui Petrochemical Industries, Ltd., "Newlight" by Saxin Corporation, "Sunfine" by Asahi Chemical Industry Co., Ltd. and "ultra high molecular weight polyethylene UHMW" by Dainippon Insatsu. Fiberglass reinforced and carbon fiber reinforced PPSs are preferable. Examples of the LCP are "VICTREX" by ICI Japan, "Sumika Super" by Sumitomo Chemical Co., Ltd., "XYDAR" by Amoco Performance Product, Inc., "VECTRA" by Polyplastics, and the like. PEEK has extremely good chemical resistance and durability with respect to all of the processing solutions of the developing apparatus, and is an ideal material which exhibits sufficient effects as an unreinforced material.

It is preferable to use EPDM rubber, silicon rubber, viton rubber, olefin base elastomers, styrene base elastomers, urethane base elastomers, PVC base elastomers and the like for the rubber material and the elastomers used for the piping, the joints of the piping, the joints of the agitation jet pipes, the seal members and the like.

Specific examples include "Sumiflex" manufactured by Sumitomo Bakelight Co., Ltd., "Milastomer" (an olefin base elastomer) manufactured by Mitsui Petrochemical Industries, Ltd., "Samoran" (an olefin base elastomer containing rubber) and "Labaron" manufactured by Mitsubishi Yuka Co., Ltd., "Santoplane" manufactured by Nippon Monsanto Kasei Co., Ltd. or AIS Japan Co., Ltd., "Sanplane" manufactured by Mitsubishi Kasei Vinyl Co., Ltd., silicon rubbers and viton rubbers disclosed in Japanese Patent Application Laid-Open (JP-A) No. 3-198052, and the like.

The materials such as plastics used in the processing tanks and other portions of the processing device described above can be easily selected and obtained on the basis of "Plastic Molding Materials Business Transactions Handbook-Characteristic Database, 1991 Edition" published by Synthetic Resin Industries Newspaper Co., Ltd. (Gosei Jushi Kogyo Shinbunsha).

As described above, the photosensitive material processing device relating to the present invention has superior effects in that conveyability of the photosensitive material is improved and reading accuracy of magnetic information is improved.

What is claimed is:

1. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and wherein the processing tank comprises:

a plurality of structural members, which are formed from a crystalline resin by injection molding, and a plurality of fastening ribs for connecting the plurality of structural members to one another, said fastening ribs being provided at outer portions of the plurality of structural members; and a plurality of fastening members for connecting said fastening ribs.

2. A photosensitive material processing device according to claim 1, wherein the processing tank is a color developing tank which stores color developing solution as the processing solution.

3. A photosensitive material processing device according to claim 1, wherein the processing tank is a bleaching/fixing tank which stores bleaching/fixing solution as the processing solution.

4. A photosensitive material processing device according to claim 1, wherein the processing tank is a stabilizing tank which stores stabilizing solution as the processing solution.

5. A photosensitive material processing device according to claim 1, wherein the processing tank is formed in a U-shape.

6. A photosensitive material processing device according to claim 1, wherein the processing tank is formed from a crystalline resin by injection molding.

7. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and a substrate of the silver halide photosensitive material is made from polyethylenenaphthalate, and wherein the processing tank comprises:

a plurality of structural members, which are formed from a crystalline resin by injection molding, and a plurality of fastening ribs for connecting the plurality of structural members to one another, said fastening ribs being provided at outer portions of the plurality of structural members; and a plurality of fastening members for connecting said fastening ribs.

8. A photosensitive material processing device according to claim 7, wherein the silver halide photosensitive layer is disposed at one side surface of the substrate of said silver halide photosensitive material and the magnetic writing layer is disposed at the other side surface of the substrate.

9. A photosensitive material processing device according to claim 7, wherein the silver halide photosensitive material is a color negative film and the color negative film is processed in the processing tank.

10. A photosensitive material processing device according to claim 7, wherein the processing tank is formed in a U-shape.

11. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and the thickness of the substrate of the silver halide photosensitive material is less than or equal to 100 $\mu$m, and wherein the processing tank comprises:

a plurality of structural members, which are formed from a crystalline resin by injection molding, and a plurality of fastening ribs for connecting the plurality of structural members to one another, said fastening ribs being provided at outer portions of the plurality of structural members; and a plurality of fastening members for connecting said fastening ribs.

12. A photosensitive material processing device according to claim 11, wherein the thickness of the substrate of the silver halide photosensitive material is less than or equal to 100 $\mu$m and more than or equal to 70 $\mu$m.

13. A photosensitive material processing device according to claim 11, wherein the thickness of the substrate of the silver halide photosensitive material is less than or equal to 95 $\mu$m and more than or equal to 80 $\mu$m.

14. A photosensitive material processing device according to claim 11, wherein the width of the substrate of the silver halide photosensitive material is less than or equal to 30 mm.

15. A photosensitive material processing device according to claim 11, wherein the processing tank is formed in a U-shape.

16. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and wherein the processing tank is formed from a crystalline resin as a surface treating material.

17. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and wherein the processing tank is formed such that pairs of conveying rollers which nip and convey the silver halide photosensitive material are disposed at an inner side of the processing tank and pairs of transmission rollers which transmit drive force to said pair of conveying rollers are disposed at an outer side of the processing tank, and the drive force from the pairs of transmission rollers is transmitted by magneticism to the pairs of conveying rollers so as to rotate the pairs of conveying rollers.

18. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and wherein the processing tank is formed in a U-shape and a circulating path is disposed in the processing tank so as to send and circulate the processing solution from a central portion of the processing tank to an introduction side portion of the processing tank, into which the silver halide photosensitive material is introduced, and to a discharge side portion of the processing tank, from which the silver halide photosensitive material is discharged.

19. A photosensitive material processing device having a processing tank in which is stored a processing solution for processing silver halide photosensitive materials, wherein the processing tank is formed from a crystalline resin and is formed such that, given that a tank volume of the processing tank is V ml and a path length which is a conveying distance from a position at which a silver halide photosensitive material begins to contact the processing solution within the processing tank to a position at which the silver halide photosensitive material is discharged from the processing solution is L cm, a value of V/L is less than or equal to 25, and wherein the processing tank is formed in a U-shape and a circulating path is disposed in the processing tank so as to send and circulate the processing solution from a central portion of the processing tank to an introduction side portion of the processing tank, into which the silver halide photosensitive material is introduced, and to a discharge side portion of the processing tank, from which the silver halide photosensitive material is discharged, and a heater which heats the processing solution to a predetermined temperature is disposed at a piping constituting the circulation path.

* * * * *